United States Patent [19]

Seragnoli

[11] 4,056,916

[45] Nov. 8, 1977

[54] COMPENSATING STORE DEVICE IN SYSTEMS FOR DIRECTLY FEEDING CIGARETTES FROM CIGARETTE MANUFACTURING MACHINE OR MACHINES TO THE HOPPER OF THE CIGARETTE PACKETING MACHINE

[75] Inventor: Enzo Seragnoli, Bologna, Italy

[73] Assignee: G. D. Societa per Azioni, Italy

[21] Appl. No.: 651,334

[22] Filed: Jan. 22, 1976

[30] Foreign Application Priority Data

Jan. 29, 1975 Italy ..... 3324/75

[51] Int. Cl.[2] ..... B65B 57/14

[52] U.S. Cl. ..... 53/59 R

[58] Field of Search ..... 53/59 R, 148; 131/25; 198/20 C, 20 R, 37, 103, 347; 214/6 TS, 1; 221/79, 81, 103, 105

[56] References Cited

U.S. PATENT DOCUMENTS

| | | | |
|---|---|---|---|
| 3,499,555 | 3/1970 | Wahle | 198/347 X |
| 3,782,523 | 1/1974 | Giatti | 198/347 |

*Primary Examiner*—Othell M. Simpson
*Assistant Examiner*—John Sipos
*Attorney, Agent, or Firm*—Robert E. Burns; Emmanuel J. Lobato; Bruce L. Adams

[57] ABSTRACT

A compensating store device for cigarettes, between cigarette manufacturing machines and machines for packeting the cigarettes, wrapping the packets and making and wrapping packs of wrapped packets. The store device comprises a cylinder intermittently rotating about a vertical axis and having vertical, radial cigarette storage compartments, circumferentially distributed. A cigarette delivery channel system at the top of this cylinder can feed cigarettes from a feeding conveyor to each successive compartment stopped below this channel; a generally similar channel system at the bottom can withdraw cigarettes. Each channel system comprises a fixed channel section communicating with consecutive storage compartments, a channel section movably mounted to selectively admit and stop a flow of cigarettes into or from the fixed section; and a solenoid for controlling the latter section. Between the two channels, successive, horizontal rods are moved into, downwardly along, and ultimately from each compartment, with the aid of a chain conveyor mechanism, to provide supports for the cigarettes store in the compartments.

10 Claims, 10 Drawing Figures

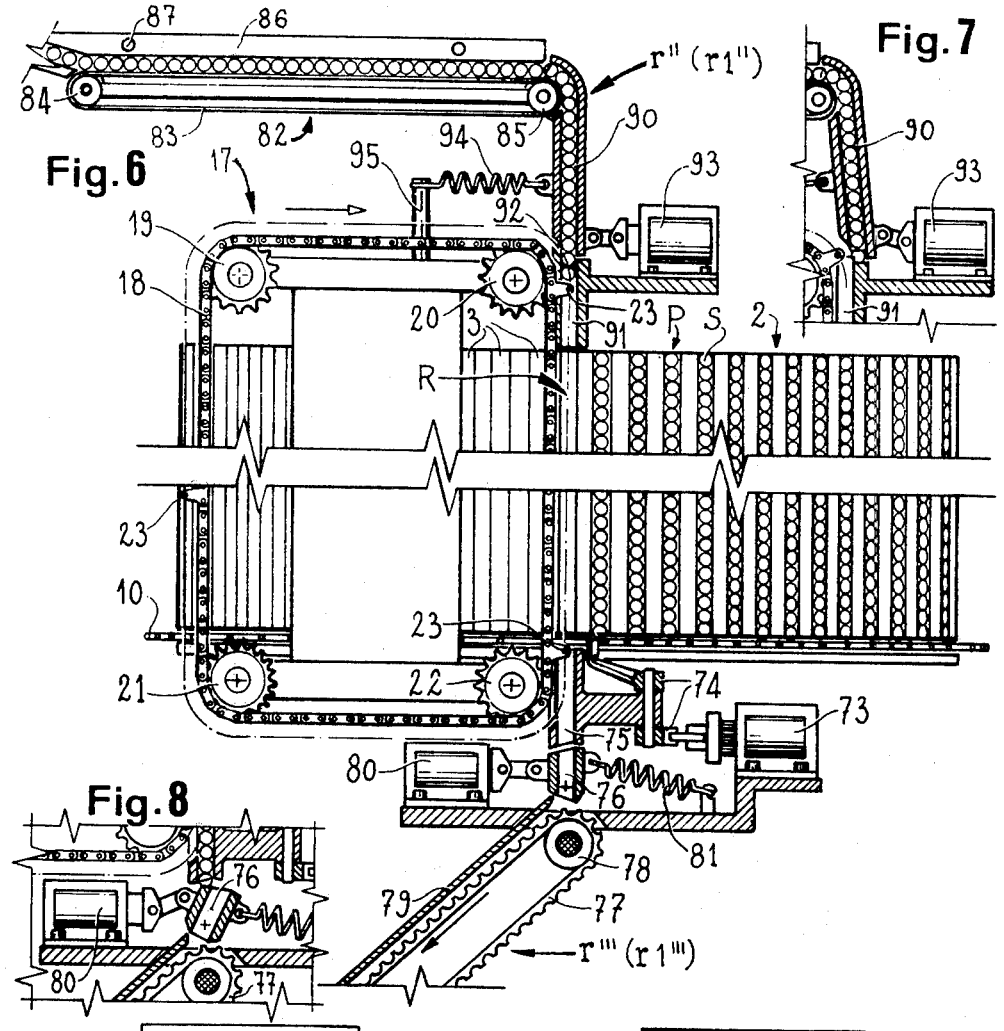
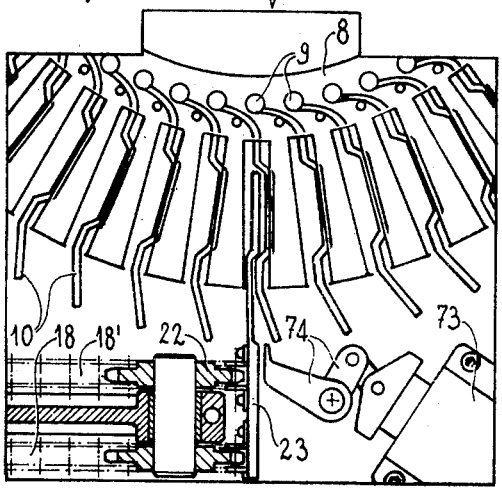
Fig. 9
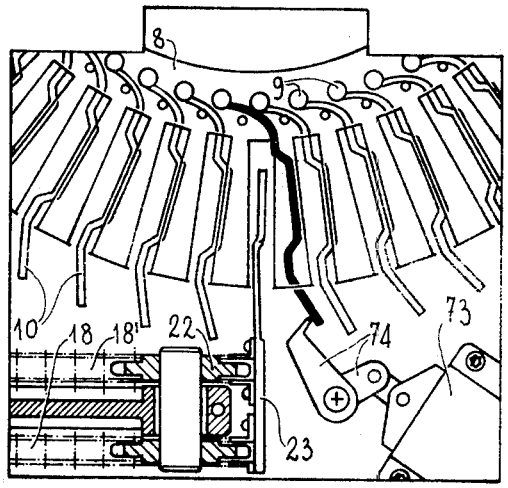
Fig. 10

COMPENSATING STORE DEVICE IN SYSTEMS FOR DIRECTLY FEEDING CIGARETTES FROM CIGARETTE MANUFACTURING MACHINE OR MACHINES TO THE HOPPER OF THE CIGARETTE PACKETING MACHINE

CROSS REFERENCE TO OTHER APPLICATIONS

This application is related to U.S. Patent Applications Ser. No. 651,332 and Ser. No. 651,335 both filed on Jan. 22, 1976.

BACKGROUND OF THE INVENTION

The present invention relates to a compensating store device to be used in systems for directly feeding cigarettes from cigarette manufacturing machines to the hopper of a cigarette packeting machine.

As known, the plants in use at present for producing cigarettes comprise two different types of machine, i.e.:

1. Machines for producing cigarettes from cut and cured tobacco leaves, usually called cigarette manufacturing machines, and 2. Cigarette packaging machines.

The machines of the second type usually comprise:

Machines for producing packets of cigarettes, usually called packeting machines;

Machines for producing packs of cigarette packets, usually called packing or pack-forming machines, and Wrapping machines for wrapping either single packets of cigarettes, called cellophaning machines, or single packs of cigarette packets, usually called "over wrapping machines".

In said plants, the cellophaning machines are located between the packeting machines and the packing or pack-forming machines, while the "over wrapping machines" are located downstream of or after the packing or pack-forming machines.

It is also known that there exist in practice various types of cigarette manufacturing machine operating at a respective output speed of 2000 to 4000 cigarettes per minute.

There also exist various types of manufacturing machines operating at output speeds ranging from 100–120 up to 400 packets of cigarettes/minute, whereas the output speed of the packing or pack-forming machines is a function of the number of packets forming the single packs. Among the wrapping machines for wrapping single cigarette packets, the type of cellophaning machine of the applicant's assignees which can wrap 400 packets of cigarettes per minute, is widely used. To wrap single packs, "over wrapping machines" operating at the same output speed as that of the packeting or packing machines co-operating therewith, are usually employed.

When considering the output speeds of the various types of machines in use at present, it is found that depending on the types of machine used in forming the plant, a packeting machine can absorb the output of one to three manufacturing machines, whereas a cellophaning machine can absorb the output or production of one to three packeting machines. As known, the cigarette supply from the manufacturing machine or machines to the packeting machine may occur substantially in two different ways, i.e.:

a. either by unloading the cigarettes into containers at the outlet of the cigarette manufacturing machine or machines, the containers being then transferred and unloaded into the assembling or grouping hopper arranged to feed the packeting line of the packeting machine, or b. by directly connecting such outlet of the cigarette manufacturing machine or machines to the grouping hopper arranged to feed the packeting line of the packeting machine.

The present invention concerns the latter branch of the art, in which the outlet of the manufacturing machine or machines is directly connected to the grouping hopper of the packeting machine.

For such type of feeding system, it was already suggested to convey the cigarettes in a continuous or uniform flow from the manufacturing machine or machines to the packeting machine, the cigarettes, while being fed, being arranged in a succession of single cigarettes or batches of cigarettes by providing along the cigarette path means arranged to permit variations in the feeding flow as a function of the variations in the delivery capacity of the manufacturing machine or machines and of the receiving capacity of the packeting machine, respectively, so as to compensate for the frequently occurring unbalances in the output of said machines.

According to the proposals known at the present, said means arranged to permit volume variations in the cigarette flow as a function of the variations of the delivery capacity and the receiving capacity of said machines are provided, conceived and designed as having structures enabling them to act on batches of cigarettes, in contact with each other inside or outside the grouping hopper of the packeting machine.

On such batchwise treating of the cigarettes, piled up during both the simple transfer stages and particularly the piling up stages in order to compensate for frequently occurring unbalances in the output of the operating machines, the cigarettes are subjected to stress. This inevitably results, already in this initial stage of the process, in a damage to the cigarette features, in particular to the structural characteristics thereof (loss of compactness in the tobacco inside the cigarette envelope or paper).

For such reasons systems have been proposed for the direct feeding system mentioned in paragraph (b) above, in which various transfer means and even means arranged to permit changes in the flow rate act on single cigarettes rather than on cigarette batches. In order to eliminate the drawbacks due to direct connection between machines running at different operating speeds, such systems have used a compensating store device for compensating for unbalances which may occur owing to such different operating speeds, the cigarettes being stored one by one in the store and being withdrawn therefrom still one by one in case of need.

For instance, a device having a substantially cylindrical body which is about equal in height to the length of a cigarette and comprising radial compartments all around it, the compartments being about equal in width to the diameter of a cigarette and variable in depth, and being arranged to contain piles of cigarettes extending parallel to the axis of said cylindrical body, is already known. Such a device is continuously rotated about its own axis and its compartments, the depth of which uniformly increases or decreases depending on whether a storing or withdrawal operation is being performed, successively reach a well determined position where during each 360° rotation every compartment receives a cigarette in the first operating condition thereof and delivers it in the second condition.

It should be noted that in view of this, such storing and withdrawing operations are carried out by following a spiral-like course.

From the above, it should appear that the maximum amount of cigarettes which can be stored is proportional to the diameter of the cylindrical body and this means that precise limits exist for the capacity and thus for the utility of such device.

Such compensating store is in fact subject to both size and weight limitations, the weight limitations being due to the fact that the speed of rotation of a particular storing and withdrawing mechanism has necessarily to match with the high output speed of the machines cooperating therewith.

It should also be noted that the cigarettes located in the innermost turns of said spiral will be only seldom withdrawn and this might be deleterious to the structural characteristics thereof.

SUMMARY OF THE INVENTION

The main object of the present invention is to obviate all the above-mentioned drawbacks by providing a direct feeding system as mentioned above, acting on single cigarettes, with a compensating store device of large capacity as compared to its relatively small dimensions, and of particularly simple structure.

Another object of the present invention is to provide a compensating store device capable of attaining the above-mentioned objects and having such a structure that it is possible to begin the cigarette withdrawing operation by starting from the cigarettes first stored.

These and still further objects are all attained by the compensating store device according to the invention for compensating unbalances occurring in the output of cigarette producing plants in which the cigarettes are directly fed from the manufacturing machine or machines to the grouping hopper arranged to feed the wrapping line of the packeting machine. The new device comprises a cylindrical body having radial cigarette-storing compartments and arranged to rotate intermittently about its own axis to carry successive radial storing compartments past means for delivering and withdrawing horizontally arranged cigarettes. According to the invention the cylindrical body, with its axis of rotation extending vertically, has an actuating mechanism, advantageously comprising a bidirectional motion source controlled by the manufacturing and packeting machines, and a transmission device intermittently operating to stop and position successive storing compartments vertically below an upper cigarette delivering duct station and above a lower cigarette withdrawing duct station. A conveyor chain or the like, carries a plurality of horizontally cantilevering rods spaced from each other, and thereby co-operates with the drive advantageously by means of a motion direction transformer device, to convey, in an position normal to the vertical axis of rotation, at least one of said rods unidirectionally into, along and from each storing compartment, stopped between the duct stations. Each rod passes laterally into and from a duct in the upper and lower station respectively supports the cigarettes while they enter the compartment; and it assists their being withdrawn therefrom. In accordance with the invention, a duct section is provided in each of said stations, beyond the trajectory of the rods, and is movably supported, and controlled by an electromagnetic control device. The packeting machine controls the mobile duct section in the delivery station, while the manufacturing machine controls the mobile duct section of the withdrawing station.

BRIEF DESCRIPTION OF THE DRAWINGS

Further characteristics and advantages will better appear from the following detailed description of a preferred but non-exclusive embodiment of the invention illustrated by way of non-limiting example only in the accompanying drawings, in which:

FIG. 6 is a side view of certain parts of said device;

FIGS. 7 and 8 show two details of FIG. 6;

FIGS. 9 and 10 are a plan view of a detail of the device according to the invention in two different operating conditions.

DESCRIPTION OF THE PREFERRED EMBODIMENT

Figure 1:
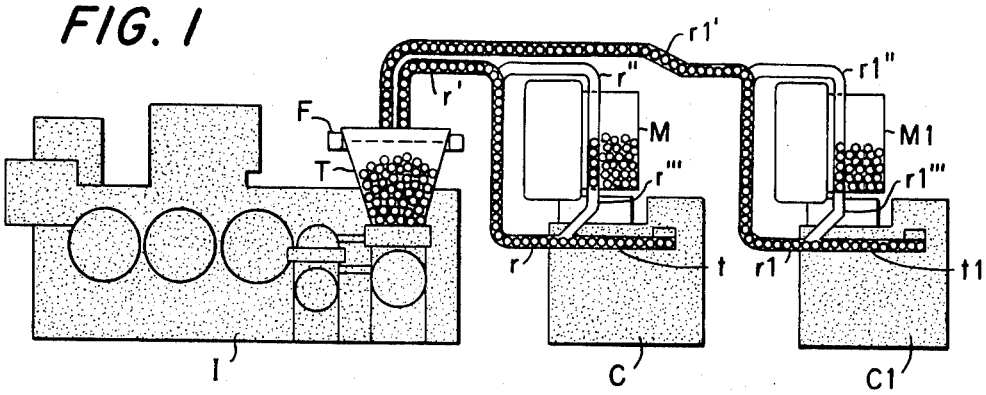
FIGS. 1, 2, 3, 4 diagrammatically show four possible operation modes of a plant according to the Patent Application Ser. No. 651,345 of the same Applicant and comprising a compensating store device according to the invention.
Figure 2:
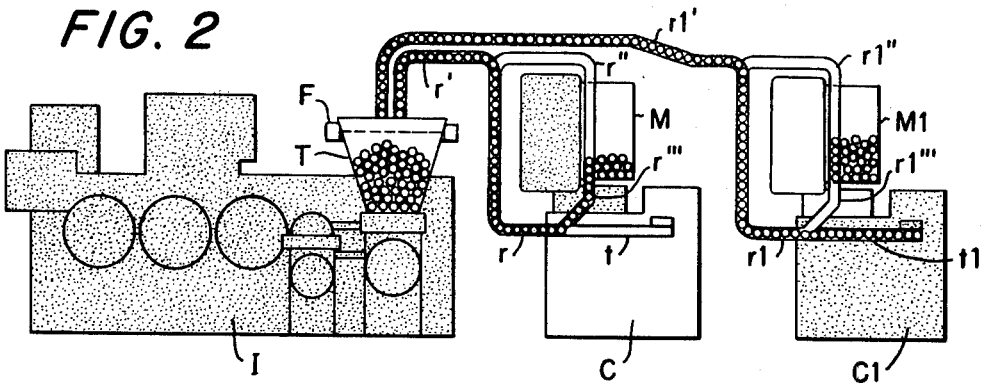
Figure 3:
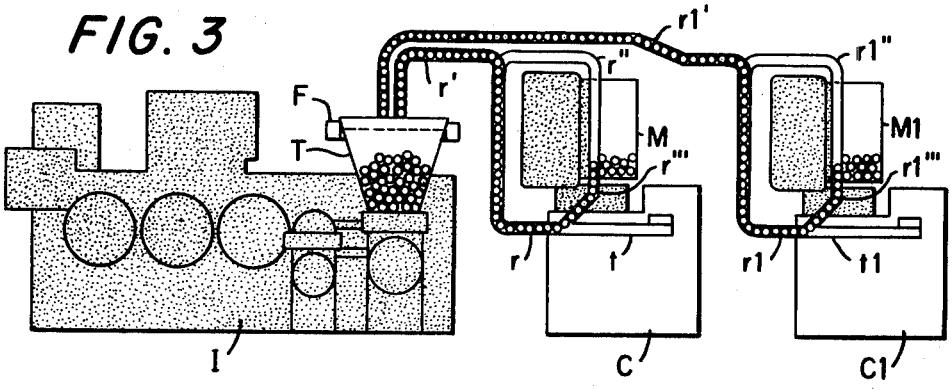
Figure 4:
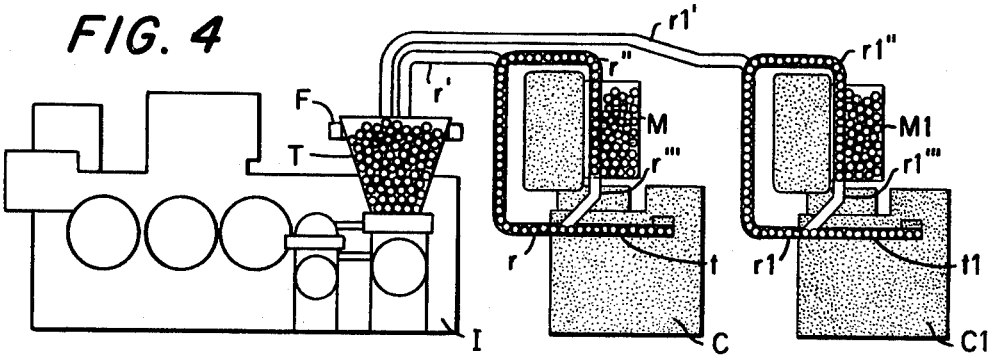

As shown in FIGS. 1, 2, 3, 4 the direct feeding system according to the above-mentioned patent application has: a packeting machine I operating at a high output speed, of the type known on the market under the name X1, of the Applicant's assignees G.D. SOCIETA PER AZIONI, which produces 400 cigarette packets per minute, the packets being of the so-called soft or American kind and each containing about 20 cigarettes; two cigarette manufacturing machines C and C1, also of known type, each of which operates at an output speed of about 4000 cigarettes per minute; and two compensating store devices according to the invention concerned, which are respectively connected to the machine C and the machine C1 and schematically shown at M and M1 respectively.

As known, the packeting machine I comprises a grouping or assembling hopper T arranged to feed groups of cigarettes to the packeting line which is a part of the same machine, and a device F of any known type, such as a photocell, arranged to detect the reaching of a predetermined maximum level of the cigarettes in the hopper T and to control cigarette switching means, not shown in the drawings, for example of the type disclosed in the Patent Application Ser. No. 651,346 of the same Applicant, when the packeting machine I stops.

The manufacturing machines C and C1 are of the type comprising a continuous conveying device *t* and *t*1, respectively, such as a belt conveyor, arranged to transfer a continuous succession of cigarettes transversely arranged with respect to the conveying or transfer direction from the outlet of the corresponding manufacturing machine to further conveying devices. Each of the latter conveying devices is of continuous type and arranged to act on single cigarettes. It comprises for example preferably grooved wheels or drums or opposed belts. It has a first ascending run or section, more precisely the section *r* which is an extension of the conveyor *t*, and the run or section *r*1 which is an extension of the conveyor *t*1. Finally, there are two sections or runs *r'*, *r''* diverging from one another which are extensions of the section *r*, and *r*1*'*, *r*1*''* which are extensions of the section *r*1.

The two runs or sections *r'* and *r1'* open into the hopper T, whereas the two runs or sections *r''* and *r1''* open into the device M or the device M1, respectively, in accordance with the present invention.

Said devices M and M1 are also connected respectively to the conveying devices *t* and *t1* by means of the section of continuous conveyor *r'''* located between M and *t*, and by means of a section *r1'''* located between M1 and *t1*. As shown, the runs *r, r'', r'''* provide a complete circuit, wherein *r''* feeds cigarettes to the compensating store device M while *r'''* withdraws cigarettes therefrom. A similar circuit is provided for M1 by runs *r1, r1'', r1'''*.

A plant of the type briefly described above which comprises compensating store devices according to the present invention arranged to compensate for frequently occurring unbalances in the output of the operating machines which are due to the manufacturing machine stops or shutdowns more frequent than those of the packaging machine, can operate according to the following different operating conditions:

A. The packeting machine I and the manufacturing machines C and C1 are operating and the compensating store devices M and M1 are not working (see FIG. 1);

B. The packeting machine I and one of the two manufacturing machines are working, while the other manufacturing machine is not working and the compensating store device of the latter is in a feeding or supplying stage (see FIG. 2, where the machine C is not working and its compensating store device M operates in a feeding or supplying stage);

C. The packeting machine I is working, the manufacturing machines C and C1 are not working and the compensating store devices M and M1 are in a feeding stage (see FIG. 3);

D. The packeting machine I is not working and at least one manufacturing machine with its compensating store device being supplied or fed (see FIG. 4, where both manufacturing machines C and C1 are working and both compensating store devices M and M1 are being supplied or fed).

Figure 5:
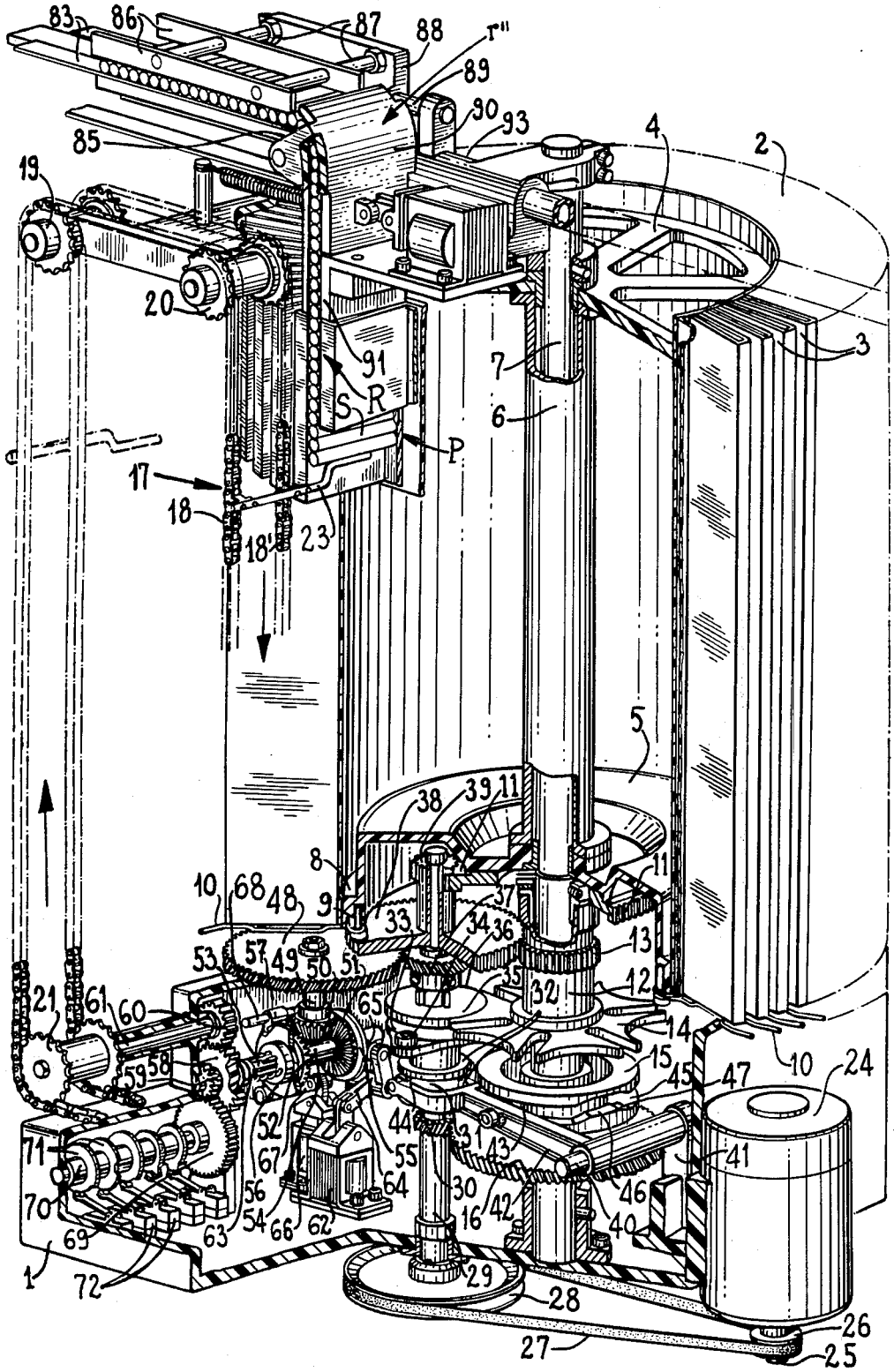
FIG. 5 is a perspective view with some parts cut away to better show others, of the device according to the invention equipped with its actuation means.

With particular reference to FIG. 5, a lower portion of a casing of the compensating store device according to the invention has been indicated here by 1. It is rigid with the base of the respective cigarette manufacturing machine, not shown here.

A hollow cylindrical body with vertical axis is generally indicated by 2 and has radial, vertical compartments 3 a few of which are shown and which are disposed all around it. They are equally spaced from each other and are about equal in radial depth and in width to the length and width, respectively, of a cigarette. They vertically extend from the top or upper base to the bottom or lower base of the cylindrical body and are arranged to be received, as will be explained below, piles P of cigarettes S from the manufacturing machine each pile being one cigarette thick.

An upper spoke plate 4 and a lower drum 5 are rigidly positioned inside said cylindrical body which forms the compensating store proper, and are also rigid with a vertical hollow shaft 6 which is rotatably supported by an inner shaft 7 which extends throughout the shaft 6 and has its ends fixed to the casing 1, the shaft 7 defining the axis about which, as will be explained below, said store can intermittently rotate in two opposite directions.

The drum 5 has at its lower part, see also FIGS. 6, 9 and 10, a ring gear 8 along which resilient rods 10 are fixed by means of vertical pins 9.

The number and circumferential distribution of rods 10 is equal to that of compartments 3. The rods 10 extend in a substantially radial direction and all lie in the same horizontal plane immediately below the lower base of the cylindrical body 2, the dimensions of the rods 10 being such as to extend to a given extent beyond the limits of said lower base.

The configuration of the rods 10 in that plane is such that each of them obstructs the two radial ends of a lower opening or outlet of one of the compartments 3 so as to form a support for a possible cigarette pile located above.

The inner shaft 7 also carries a gear 11 rigid with the lower portion of the drum 5, and therebelow, an outer hollow idle shaft 12 on which a gear 13 is formed.

At the lower end of the hollow shaft 12, a 6-slot Maltese cross 14 is keyed to transmit the intermittent rotational movement to the cylindrical body 2, as will be better explained below.

Said shaft 7 also carries below the hollow shaft 12 a drum cam 15 and a gear 16 which are idly mounted thereon and rigid with one another.

The end portion of the section or run (*r''* or *r1''*) arranged to feed the cigarettes to the compensating store device is located immediately above the said cylindrical body 2, whereas the initial length of the run or section (*r'''* or *r1'''*) arranged to withdraw the cigarettes from said device is located immediately below said cylindrical body 2 (FIG. 6). Such end and initial lengths are vertically aligned with one another and have an outlet and an inlet, respectively, radially extending with respect to the cylindrical body 2. They jointly define a station R at which the compartments 3 come to stop one by one to perform filling or, alternatively, unloading operations.

Moreover, a conveying means is indicated by 17 (see FIGS. 5 and 6) and comprises two chains 18, 18' located side by side and endlessly wound around four pairs of sprocket wheels, 19, 20, 21 and 22, which have horizontal axes parallel to a diametrical plane passing through said feeding and withdrawing station R, said conveying means being continuously moved clockwise with respect to an observer looking at FIGS. 5 and 6 by means described below.

One of the pairs of sprocket wheels, 19, 20, 21, 22, as will be better described below, is motor-driven. The four pairs are arranged at the corners of a rectangle so that a downwardly moving run of the moving from above downwards of said conveyor is located close to said feeding or withdrawing station R.

The two chains 18, 18' are connected to one another at regular intervals by three bars 23 transversely arranged with respect to the conveying direction. They cantilever from the chains toward the axis of the cylindrical body 2 so that they can be deeply inserted firstly into a terminal end of the feed run or section (*r''* or *r1''*), and therebelow into the compartment 3 which is located at station R. Therebelow they leave this compartment and pass through an initial portion of the withdrawing section (*r'''* or *r1'''*) without however interfering with said rods 10.

As a primary source of motion the device according to the invention uses a motor 24 which can rotate in either direction of rotation and is fixed to the casing 1 to rotate the body 2 through a kinematic transmission in either of the two directions. A pulley 26 is keyed on the vertical shaft 25 of such motor 24. The pulley 26 rotates, through the drive belt 27, a second pulley 28 which is keyed to a lower end, projecting from the casing 1, of a vertical shaft 29. A gear 30 being one of the parts of the kinematic transmission is keyed on such shaft 29 within the casing 1, this gear 30 being arranged to rotate the already-mentioned gear 16 and drum cam 15.

Above the gear 30 there are mounted, rigid with one another and free to axially slide on said shaft 29, in the order from below upwards, a tubular sleeve 31 on which two equal rings 32 are keyed and suitably spaced apart from one another, and also a device of known type arranged to intermittently actuate the Maltese cross 14. Such device comprises at its lower part a disc 33 which has a pin or an idle roller 34 with vertical axis and a second disc 35 arranged above the roller 34 and having, depending from its edge, an arcuate or centering sector 36 located diametrically opposite to said roller 34.

Moreover, a gear 37 is fixed on said shaft 29 above said disc 36 and finally, two gears 38 and 39 are idly mounted on the shaft 29 and rigid with one another, the gears 38 and 39 being arranged to mesh with respective gears 13 and 11 already mentioned above.

The actuation of the Maltese cross 14 and thus, the resulting intermittent actuation of the cylindrical body 2, in one direction or in the opposite direction, occurs in the following manner. One end of a lever 42 is fulcrumed on a horizontal pin 40 fixed to a vertical bar 41 internally rigid with the casing 1. The lever 42 has an intermediate horizontal axis idle roller 43 arranged to run along the groove of the drum cam 15 driven by gear 16.

The other end of the lever 42 terminates with two arms each of which carries an idle roller 44 with horizontal axis.

Such rollers 44 are inserted in a diametrically opposed arrangement one with respect to the other into the tubular sleeve 31 between the two already-mentioned rings 32.

The groove in the drum cam 15 extends along the lateral surface of the cam at two different levels, i.e. a prevailing length 45 at a lower level and a length 46 at a higher level, spaced from one another by inclined sections 47.

While the idle roller 43 runs along the length or section 45 at the lower level (see FIG. 5), the idle roller 34 idly rotates about the shaft 29 at a lower level with respect to that of the Maltese cross 14, while the disc 35 which rotates in engagement with the arcuate end of one of the arms of such Maltese cross 14, acts as a stabilizing element in such conditions.

At the end of this stage, the dwelling stage of the cylindrical body 2, upon further rotation of the drum cam 15, one of the inclined sections 47 and thus the length or section 46 at a higher level, move past the idle roller 43.

Accordingly, the lever 42 rotates upwards about the pin 40 thereby causing, by means of the idle rollers 44, the tubular sleeve 31 to axially slide and thus causing the idle roller 34 and the arcuate sector 36 to be transferred to the respective operating zone of actuation of the Maltese cross 14.

The raised cam section 46 extends enough to permit, at each 360° rotation of the drum cam 15, the rotation of a step, i.e. of 60°, of the Maltese cross 14. This causes a rotary movement of the cylindrical body 2 by a small angular step, corresponding to the angle defined by two contiguous compartments 3, by means of suitably dimensioning the gears 13, 38 and 39, 11 as two pairs of speed reduction gears.

The above-mentioned kinematic transmission includes gear 37 rigid with the vertical shaft 29 and which drives a gear 48 mounted on a vertical shaft 49, the lower end of which is rigid with a bevel gear 50.

Said gear 50 in turn rotates either of two equal bevel gears 51, 52 having opposite toothings, being mounted axially slidable on a horizontal shaft 53 carried by the casing 1, and being rigidly connected to one another by means of a tubular sleeve 54 mounted on the same shaft 53.

Two discs 55, 56 equal to one another and having a diameter greater than that of said gears, are mounted on the horizontal shaft 53 close to and rigid with the bevel gear 51 and the bevel gear 52, respectively, on the opposite side to the respective toothings. A cut 57, the function of which will be explained below, is formed in the periphery of each of the discs 55, 56.

The two assemblies comprising said bevel gears 51 and 52 and the respective discs 55 and 56 formed with the cut 57 are mounted on the shaft 53 in such a way as to be each a mirror image of the other.

Moreover, gears 58 and 59 are keyed on the shaft 53, the gear 58 rotating a horizontal shaft 61 through a gear 60. The horizontal shaft 61 carries the sprocket pair 21 mentioned above which continuously rotates in the same direction.

The mechanism comprising said bevel gears 51 and 52 permits the drive 24 to 50 to effect a uniform direction of rotation of the shaft 61 and thus a uniform conveying direction of the chain conveyor, and this independently of the direction of rotation of the motor 24 and cylindrical body 2. When the drive 24 - 50 intermittently rotates the cylinder in one direction, for a cigarette-storing operation, the bevel gear 50, as shown, mates with the first bevel gear 51, whereby the sprocket pair 21 is rotated in clockwise direction as desired.

On the contrary, i.e. in the condition where the cylindrical body 2 intermittently rotates in the opposite direction, for a cigarette delivery operation, the bevel gear 50 which now rotates in the opposite direction is caused to mesh with the second bevel gear 52, thereby obtaining the rotation still in clockwise direction of the sprocket pair 21. The coupling of bevel gear 50 to the gear 51, or alternatively, to the gear 52, is performed by an electromagnet 62 mounted in casing 1, in combination with a spring 63 mounted on the shaft 53 in the zone delimited between the disc 56 and the gear 58.

The keeper of such electromagnet 62 is connected to one arm of a lever 64 which is pivoted on means rigid with the casing 1 and the other arm of which is fork-shaped and carries two idle rollers 65 each having a horizontal axis and being arranged to engage with the disc 55 at the rear face portion with respect to a viewer of FIG. 5.

In order to set the device according to the invention in the cigarette-storing condition described above, the electromagnet 62 is energized, and through the lever 64 and against the resistance of the spring 63 it causes the assembly comprising the bevel gear 51 to axially slide from the right-hand towards the left-hand and thus causes the bevel gear 51 to mesh with the bevel gear 50, which at this time rotates in counter-clockwise direction.

In order to set the device in the cigarette-delivering condition electromagnet 62 is instead de-energized, and owing to the urging action of the spring 63 the bevel gear 52 is caused to mesh with the bevel gear 50, then rotating in the clockwise direction.

A second electromagnet 66 rigid with the casing 1 has a keeper connected to one arm of a two-armed lever 67 which is pivoted in the casing 1 and has, at the free end of its second arm, a rod 68 parallel to the shaft 53.

While the device according to the invention changes from one to another of said operating conditions, upon stopping the motor 24 and before reversing its direction of rotation, the electromagnet 66 is energized.

As a consequence, the ends of the rod 68 come into contact with the contours of the two discs 55 and 56 rotating due to inertia and then enter the two cuts 57 so as to form a guide element during the meshing change operation between the bevel gear 50 and the two bevel vears 51 and 52.

At the end of this operation, upon setting in motion of the motor 24 in a direction of rotation opposite to the previous one, the sprocket pair 21 starts rotating again always in the same direction of rotation.

The gear 59, which always rotates, in the same direction, as explained above, drives a gear 69 which is keyed at one end of a shaft 70 parallel to the shaft 53.

A plurality of control cams 71 are keyed on such shaft 70, the cams 71 controlling the various electromagnets of the device according to the invention through microswitches 72 connected thereto.

After the foregoing description of the principal actuating members of the new device, we shall examine now the performance of such device in the various operating modes as previously mentioned under paragraphs A, B, C, D, of the plant of which it is a part.

In the standard operating condition of said plant referred to under paragraph A (see FIG. 1), i.e. when the packeting machine I and the manufacturing machines C and C1 are working, the cigarettes at the outlet of such manufacturing machines C and C1 are directly conveyed or transferred in succession to the inside of the hopper T by means of respective conveying means *t, r, r'* and *t*1, *r*1, *r*1'.

In such condition, the compensating store devices M and M1 remain idle and the respective motors 24 are in a stop or dwelling condition. Cigarettes in compartments 3 are supported by rods 10, as indicated above.

In case of stops, owing to well-known causes, of one or both manufacturing machines C and C1 (conditions B or C, (see FIG. 2 or FIG. 3, respectively), the continuity of the cigarette supply to the conveyors *r, r'* and/or *r*1, *r*1', respectively, is ensured by the compensating store devices M and M1.

In such conditions, with reference for instance to the device M, suitable circuits (not shown) cause actuation, and direction of rotation, of the motor 24 so as to cause the cylindrical body 2 to rotate in clockwise direction so that for each movement or step forward a compartment 3 full of cigarettes dwells opposite the station R, i.e. at the inlet of the run or section *r'''* arranged to withdraw or remove the cigarettes (FIG. 6).

During such dwelling, an electromagnet 73, the keeper of which is connected to the end of one arm of the two-armed lever 74 pivoted on a vertical axis supported by means rigid with the casing 1 (FIG. 10), is energized by the circuits, including one of the microswitches 72, which is operated by the continuing unidirectional rotation of shaft 70.

The second arm of said lever 74 acts on the free end of the resilient rod 10 arranged to co-operate with the compartment 3 dwelling opposite the station R, so as to bend said rod in a direction opposite to the direction of forward movement of the cylindrical body 2 and to free or open the outlet of such compartment 3.

The respective pile or batch P of cigarettes S, once it has been thus freed from its support, is supported and controlled only by one of the bars 23 fixed to the chains 18, 18' and is thus caused to slide from its compartment 3, in response to the descending movement of the adjacent run of conveyor 17. The cigarettes thereof are thereby directed into and through a vertical channel or duct 75 delimited by two fixed and parallel side walls (FIGS. 6 and 8).

Once the bar 23 has reached the end of the descending vertical length of conveyor 17, it is disengaged from said duct or channel 75 by through a slot formed in the left-hand side wall thereof whereupon the pile or batch P of cigarettes S continues its descent by free-falling.

At the end of said fixed duct or channel 75 a second duct or channel 76 delimited by two side walls parallel to and rigid with one another is provided. According to the invention this second duct is arranged to take two different positions, i.e. an inclined position so as to temporarily close or block the outlet of the fixed channel or duct 75 located above by means of one of said side walls (FIG. 8), and a vertical position so as to connect said fixed duct 75 to an inclined continuous conveyor 77 endlessly wound around wheels 78 and formed with grooves extending transversely to its conveying direction and having a lid or cover 79 arranged to prevent cigarettes from falling out, at its upper run (FIG. 6).

The double positioning of said length or section of channel 76 can be effected in the following way.

Its lower end is pivoted on an axis rigid with the casing 1 of the device and parallel to its side walls one of which, the left-hand one for a person viewing FIGS. 6 and 8, is connected to the keeper of an electromagnet 80 mounted on a plate rigid with the casing 1, whereas the second side wall is connected through a spring 81 to a vertical pin fixed to the same plate.

The circuits including microswitches 72 are disposed so that, at the time of arrival of the first cigarette S of the pile or batch P, the electromagnet 80 is in a de-energized condition and the duct 76 is in the inclined position shown in FIG. 8 under the action of the spring 81.

In this way, and by the magnet 66, descending of the cigarettes in compartment 3 is prevented. The electromagnets are then immediately energized through suitable ones of the microswitches, thereby starting chains 17 while duct 76 is vertically aligned, against the resistance of the spring 81, with the upper fixed channel 75, thereby connecting it to the conveyor 77.

It should be noted that said fixed channel 75, the channel 76 and the conveyor 77 form together the connection indicated by *r'''* in FIGS. 1, 2, 3, 4 in connection with the machine C and by *r'''* in connection with machine C1.

When the packeting machine I has stopped and one or both manufacturing machines C and C1 are working (condition D, see FIG. 4), as soon as the cigarettes inside the hopper T have reached the maximum predetermined level, cigarette-switching means, those disclosed in said Patent Application Ser. No. 651,346 of the present applicant, are controlled by the photocell device F, these switch or switching means being located in the zone where the run or section *r* joins to the run *r'* and *r''* and the area where the run *r*1 joins to the runs *r*1' and *r*1'', so as to convey the cigarettes from the manufacturing machines C and C1 to the respective compensating store devices M and M1.

FIGS. 5 and 6 show the end section of the cigarette-supplying run $r''$ ($r''$) comprising a horizontal conveyor 82 followed by a vertical connection system.

Said horizontal conveyor 82 has two belts 83 arranged in the same plane, and endlessly wound on pulleys 84 and 85, and driven in a continuous motion by which are not visible in said Figures.

The cigarettes arranged transversely to the conveying direction, as mentioned above, are supported by either of said belts and move forward side by side while being maintained in the correct position by two listels or guide strips 86 extending parallel to the belt conveyors above the row of cigarettes and tangent with the ends of the latter.

Such listels 86 are supported through transverse rods 87 by a plate 88 arranged normal to the axis of the cigarettes and carried in turn by a pin 89 fulcumed on means rigid with the casing 1.

The vertical connection system following channel 82 comprises an upper channel or duct 90 fulcumed on the pulley 85 and arranged to take two different positions, and a lower fixed vertical channel 91. The outlet of the latter is located at, and thereby in cooperation with the aforementioned lower fixed channel 75 defines, the vertical station R of the compensating store device M (M1).

Both channels 90 and 91 are delimited by two parallel side walls arranged at a mutual distance slightly larger than the diameter of a cigarette.

Between the left-hand side wall of the upper channel 90 and the left-hand side wall of the lower channel 91 (see FIGS. 5 and 6) a slit or discontinuity 92 arranged to permit the passage of the bars 23 is formed at the level of the upper horizontal run of the conveyor 17.

The upper channel 90 can, as mentioned above, take two different positions, i.e. an inclined position such that its outlet is blocked or closed by the right-hand side wall of the lower fixed channel 91 (see FIG. 7), and a vertical position in alignment with the lower channel 91 (FIGS. 5, 6). These two positions are reached with the aid of one of the aforementioned microswitches 72, by energizing and de-energizing, respectively, an electromagnet 93 mounted on a plate rigid with the casing 1 and connected to the right-hand side wall of the channel 90 through its keeper.

Such electromagnet 93 operates in combination with *a* spring 94 fixed to one end of the left-hand side wall of the channel 90 and to a vertical pin 95 rigid with the casing 1 at the outer end thereof.

On arrival of a new compartment 3 at station $R_1$ the upper channel 90 is at first in its inclined position (electromagnet 93 in an energized condition), so that the continuous row of cigarettes descending due to gravity from the horizontal conveyor 82 is stopped by the upper end of the right-hand side wall of the lower channel 91.

As soon as the bar 23 enters the zone between the side walls of the lower channel 91, the action of the electromagnet 93 is terminated and the upper channel 90 is arranged in a vertical position by spring 94 to feed a row of cigarettes for forming a pile P filling the compartment 3 arranged below.

The row of cigarettes carried by the bar 23 descends through the lower channel 91 and thus inside the compartment 3 of the cylindrical body 2 which is dwelling opposite the station R.

After the bar 23 has left the lower end of said compartment 3, the rod 10, as mentioned above, ensures the support of the pile or batch P of cigarettes S.

In such conditions, the cylindrical body 2 is ready to make a further step thereby transferring a new empty compartment 3 to the position opposite the station R.

Of course, the above-described embodiment of the compensating store device has been given by way of example and it should appear that by means of simple and obvious measures the cylindrical body having radial compartments can be given a unidirectional movement during the two storing and delivering stages, respectively, so as to avoid a long dwelling time of piles of cigarettes inside the store.

I claim:

1. Apparatus for compensating operating unbalances of machines for producing and packeting cigarettes, comprising:

a compensating storage cylinder having means for intermittently rotating it about a vertical axis to provide a regular succession of stops of the cylinder, the cylinder having vertically and radially extending cigarette-storing compartments distributed about the cylinder's circumference, each compartment having a generally open top and a generally open bottom and being dimensioned to permit horizontally disposed cigarettes in a cigarette pile one cigarette thick to perform sliding movements downwardly into, along and from the compartment;

cigarette support means for selectively enabling such movements of the cigarettes in synchronism with the stops of the cylinder;

a conveyor system, including, a cigarette-feeding conveyor movable for feeding a stream of individual cigarettes from a cigarette-producing machine to a first fixed location adjacent the top of the cylinder upon a first type of operating unbalance between the producing machine and a cigarette packeting machine, and a cigarette-withdrawing conveyor for withdrawing a stream of individual cigarettes from a second fixed location at the bottom of the cylinder and feeding it to the packeting machine on a second type of operating unbalance between the machines, the second fixed location being vertically below the first fixed location;

means for selectively actuating the conveyors while also actuating the cigarette support means in response to either type of unbalance and during the same;

a transfer system interposed between each conveyor and the cylinder and comprising a pair of transfer channel units, one at each fixed location, each transfer channel unit comprising a vertical fixed channel and a channel movable between a vertical and an inclined position, the channels of each unit being disposed in sequence, one with the other, between the respective conveyor and a point at an end of each successive cylinder compartment disposed between the fixed locations during each stop; and transfer control means for, sequentially, holding the movable channels of both transfer channel units in their inclined position during the rotating of the cylinder to prevent said sliding movements, and holding the movable channel of one transfer unit in its vertical position during a stop of the cylinder, to insure the sliding movements of the cigarettes into the compartments during the first type of unbalance and from the compartments during the second type of unbalance.

2. Apparatus according to claim 1 in which the transfer channel unit interposed between the cylinder and the cigarette-feeding conveyor has the movable channel thereof between said conveyor and the respective fixed channel.

3. Apparatus according to claim 2 in which the transfer channel unit interposed between the cylinder and the cigarette-withdrawing conveyor has the movable channel thereof between said conveyor and the respective fixed channel.

4. Apparatus according to claim 1 in which the transfer control means comprises a pair of electromagnets, one for each transfer channel unit, and switches controlled by the cylinder-rotating means for selectively energizing either electromagnet, depending on the type of unbalance to move the respective movable channel into its inclined position.

5. Apparatus according to claim 4 in which the cylinder-rotating means comprises primary gear means for rotating the cylinder in opposite rotary directions during the two types of unbalance, and secondary gear means for unidirectionally controlling the switches.

6. Apparatus according to claim 5 in which the secondary gear means is disposed also unidirectionally to drive the cigarette support means.

7. Apparatus according to claim 1 in which the cylinder has a flexible horizontal rod at the bottom of each compartment for generally closing the same, the transfer control means including means for flexing the rods of successive compartments disposed between the fixed locations during successive stops, during the second type of unbalance, to open the bottom for the sliding movements of cigarettes from the compartments.

8. Apparatus according to claim 1 in which the cigarette support means comprise spaced-apart horizontal rods, and means for moving one of the rods downwardly into, through and from each successive one of the compartment, enabling a corresponding cigarette pile to perform the sliding downward movement thereof.

9. Apparatus according to claim 8 including conveyor chain means selectively driven by the means for rotating the cylinder to stop the rods during the moving of the cylinder and to move the rods, while holding them in a position normal to the vertical cylinder axis, during the stops of the cylinder.

10. A compensating storage unit for compensating operating unbalances of manufacturing and packeting machines in a plant for producing cigarette packets, which plant comprises a system for directly feeding a stream of individual cigarettes, disposed transversally of the stream, from at least one manufacturing machine to a packeting machine, the unit comprising;

a cylindrical body having its cylinder axis vertically disposed and having radially extending cigarette-storing compartments parallel to said vertical axis, each compartment having an open top and an open bottom and being dimensioned to permit cigarettes to be horizontally disposed in a cigarette pile one cigarette thick in the compartment between the top and the bottom, an upper cigarette infeeding channel and a lower cigarette withdrawing channel respectively positioned above and below said cylindrical body in the area thereof including said open tops and open bottoms of said compartments, said upper infeeding and lower withdrawing channels being vertically aligned one relative to the other, a movable device having uniformly spaced apart rigid cantilever rods to take successive ones of said rods, perpendicularly to the vertical axis of the cylindrical body, into and along one of the radially disposed cigarette-storing compartments which is in vertical alignment with and between said upper infeeding and lower withdrawing channels, and intercepting means for stopping a stream of individual cigarettes along said upper infeeding and lower withdrawing channels, relative to the open top and open bottom of said one cigarette-storing compartment, in synchronism with transitions of individual successive cigarette-storing compartments between said upper infeeding and lower withdrawing channels;

a bidirectional continuous movement source controlled by cigarette manufacturing and packeting machines;

a kinematic movement transmission connected to said bidirectional continuous movement source;

an intermittent movement transmission device connected to said kinematic transmission to transmit an intermittent movement to said cylindrical body for rotating it about its vertical axis;

control means for deriving from the bidirectional continuous movement source a unidirectional continuous movement, said control means being connected to said kinematic transmission to transmit the unidirectional continuous movement to said movable device and rods to determine and to accompany groups of cigarettes, as portions of the stream of individual cigarettes, in said one of the compartments; and movable sections of said upper infeeding and lower withdrawing channels independent of said movable device, providing parts of said intercepting means, and controlled by the manufacturing and packeting machines to stop the flowing of the individual cigarette stream along said upper infeeding and lower withdrawing channels during and in synchronism with each step of the intermittent rotational movement of the cylindrical body.

* * * * *